US011148772B2

(12) United States Patent
McKellips et al.

(10) Patent No.: US 11,148,772 B2
(45) Date of Patent: Oct. 19, 2021

(54) FLOTATION DEVICE LAUNCHING SYSTEM

(71) Applicants: Thomas McKellips, Morrisville, MO (US); Cody McKellips, Morrisville, MO (US)

(72) Inventors: Thomas McKellips, Morrisville, MO (US); Cody McKellips, Morrisville, MO (US)

( * ) Notice: Subject to any disclaimer, the term of this patent is extended or adjusted under 35 U.S.C. 154(b) by 139 days.

(21) Appl. No.: 16/664,001

(22) Filed: Oct. 25, 2019

(65) Prior Publication Data

US 2020/0130791 A1 Apr. 30, 2020

Related U.S. Application Data

(60) Provisional application No. 62/750,811, filed on Oct. 25, 2018.

(51) Int. Cl.

| | |
|---|---|
| ***B63C 9/22*** | (2006.01) |
| ***B63C 9/08*** | (2006.01) |
| ***B63C 9/26*** | (2006.01) |
| ***F41B 11/80*** | (2013.01) |

(52) U.S. Cl.

CPC ..... *B63C 9/22* (2013.01); *B63C 9/08* (2013.01); *B63C 9/26* (2013.01); *F41B 11/80* (2013.01)

(58) Field of Classification Search

CPC .. B63C 9/00; B63C 9/08; B63C 9/081; B63C 9/22; B63C 9/26; F41B 11/80

USPC ..... 441/80, 85; 124/73

See application file for complete search history.

(56) References Cited

U.S. PATENT DOCUMENTS

| | | | | |
|---|---|---|---|---|
| 4,332,234 | A * | 6/1982 | Allen | F41B 11/00 441/85 |
| 4,799,906 | A | 1/1989 | Perkins, Jr. | |
| 5,584,736 | A | 12/1996 | Salvemini | |
| 5,775,966 | A | 7/1998 | Real | |
| 6,379,207 | B1 * | 4/2002 | Castagner | B63C 9/26 441/85 |
| 8,469,015 | B2 | 6/2013 | Gerwig | |
| 8,869,782 | B2 * | 10/2014 | Blackman | B63C 9/081 124/71 |
| 9,056,661 | B2 * | 6/2015 | Macri | B63C 9/26 |
| 9,415,847 | B2 | 8/2016 | Minecci | |
| 9,546,855 | B2 * | 1/2017 | Higham | B63C 9/26 |
| 2013/0247892 | A1 | 9/2013 | Blackman | |

* cited by examiner

*Primary Examiner* — Lars A Olson

(74) *Attorney, Agent, or Firm* — Runyan Law; Charles Runyan

(57) ABSTRACT

A pneumatic rescue system; the pneumatic rescue system includes a housing having a tank-section, a connector-section, and a barrel-section; and a flotation-device configured to provide buoyancy to an individual stranded in a body of water. The pneumatic rescue system provides a rapid response designed to reach stranded individuals by firing the flotation-device to the individual.

19 Claims, 7 Drawing Sheets

FLOTATION DEVICE LAUNCHING SYSTEM

CROSS REFERENCE TO RELATED APPLICATION

The present application is related to and claims priority to U.S. Provisional Patent Application No. 62/750,811 filed Oct. 25, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of flotation devices and more specifically relates to a flotation device launching system.

2. Description of Related Art

People trapped in lakes, rivers, ponds, etc. may be unable to reach shore on their own. Rescue personnel may be forced to enter the body of water to rescue the stranded individual. The rescue personnel may be put in danger when trying to rescue the stranded person. People who may be at risk of drowning need swift rescue to ensure safety. A suitable solution is desired.

U.S. Pat. No. 5,584,736 to Marcus Salvemini relates to a self-propelled rescue apparatus. The described self-propelled rescue apparatus includes a flotation device in a collapsed condition from the launcher to a distressed target, the launcher and flotation device being connected by a flexible line, so that when the missile is aimed and launched toward the target, the flotation device is carried to the target and then deployed automatically to provide flotation support and establish a "life-line" from the launcher.

BRIEF SUMMARY OF THE INVENTION

In view of the foregoing disadvantages inherent in the known flotation devices art, the present disclosure provides a novel flotation device launching system. The general purpose of the present disclosure, which will be described subsequently in greater detail, is to provide a rapid response, long-reach water rescue tool configured to reach stranded individuals.

A pneumatic rescue system is disclosed herein. The pneumatic rescue system includes a housing which may include a tank-section including a first-pipe which may have a pipe-cap attached to a distal-end thereof. The first-pipe may further include an air-capacity holding means configured to receive compressed-air from an air-tank. A connector-section may be connected to the tank-section. A barrel-section may be connected to the connector-section and include a second-pipe which may have a projectile-capacity.

Further, a flotation-device may be housed within the projectile-capacity. The flotation-device may be attached to a surface, such as a boat, or an object located on a boat to stabilize the flotation-device. The flotation-device may be configured to provide buoyancy to an individual stranded in a body of water. The flotation-device may additionally be configured to be ejected at will from the projectile-capacity upon exertion of a manipulatable force caused via action of the compressed-air on the flotation-device.

A method of using the pneumatic rescue system is also disclosed herein. The method of using pneumatic rescue system may comprise the steps of: providing the pneumatic rescue system as above; coupling the air-tank to the tank-section; filling the air-capacity with compressed-air; and ejecting the flotation-device from the projectile-capacity into the body of water for rescuing use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a flotation device launching system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to flotation devices and more particularly to a flotation device launching system as used to improve public safety.

Generally, disclosed is a system including a launcher and an elongated buoy which, when shot toward a stranded individual, can help support his/her weight to ensure safe rescue, allowing people to be rescued without a rescuer needing to enter a body of water.

The system may utilize a pneumatic charge configured to propel the elongated buoy forward in order to reach the stranded person. The system may include the launcher which may include a pneumatic system charged via a firefighter's air pack, such that when the elongated buoy is needed, it is launched from the launcher. The elongated buoy may be attached to an end of a rope. The elongated buoy may help support a weight of a person being rescued.

The system may be constructed using PVC components and may be available in multiple sizes depending on launch distance required. Exact size, measurement, construction, and design specifications may vary upon manufacturing.

Referring now more specifically to the drawings by numerals of reference, there is shown in FIGS. 1A-5, various views of a pneumatic rescue system ("system" 100).

Figure 1A:
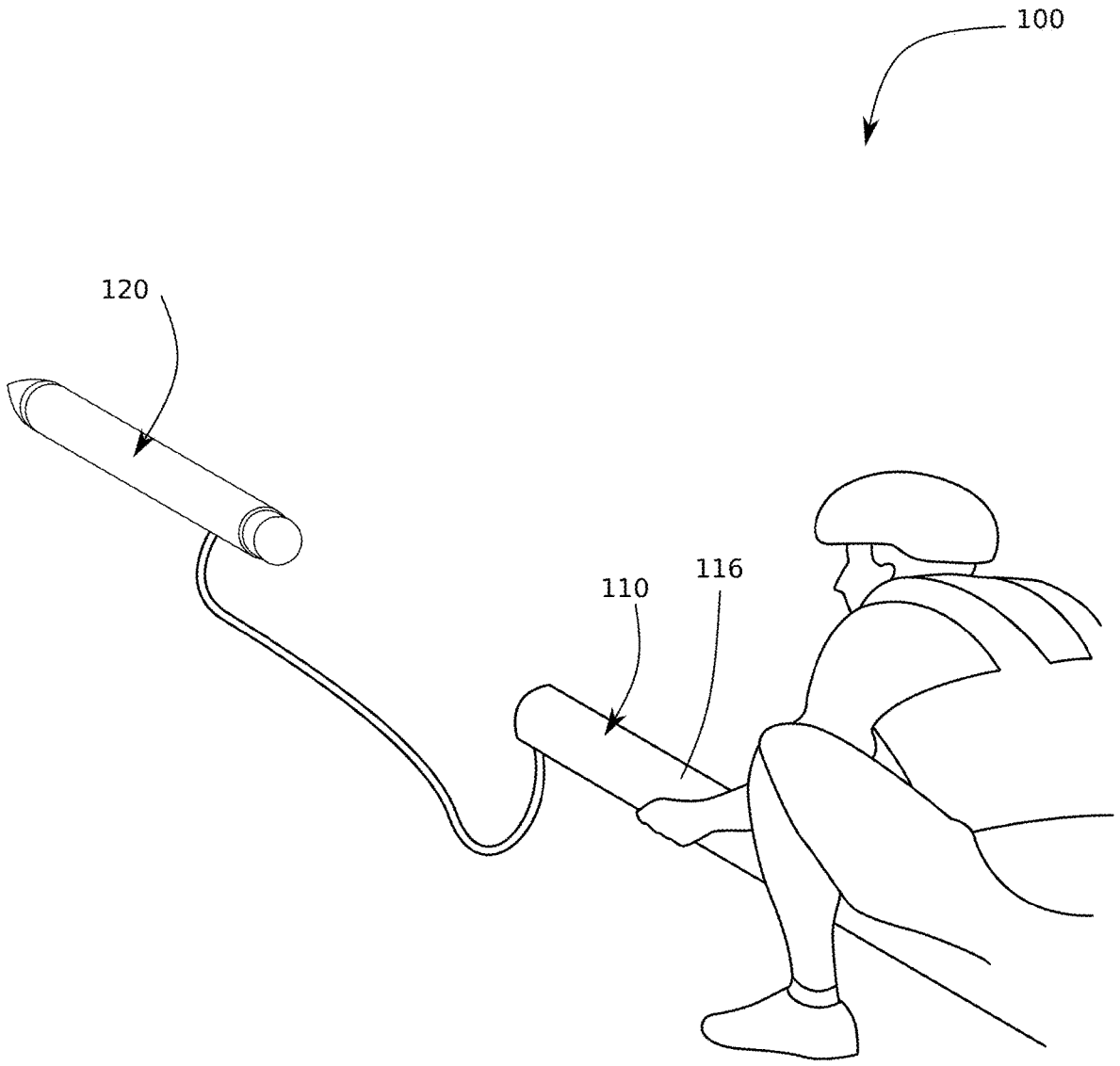
FIG. 1A is a rear side perspective view of the pneumatic rescue system during an 'in-use' condition, according to an embodiment of the disclosure.
Figure 1B:
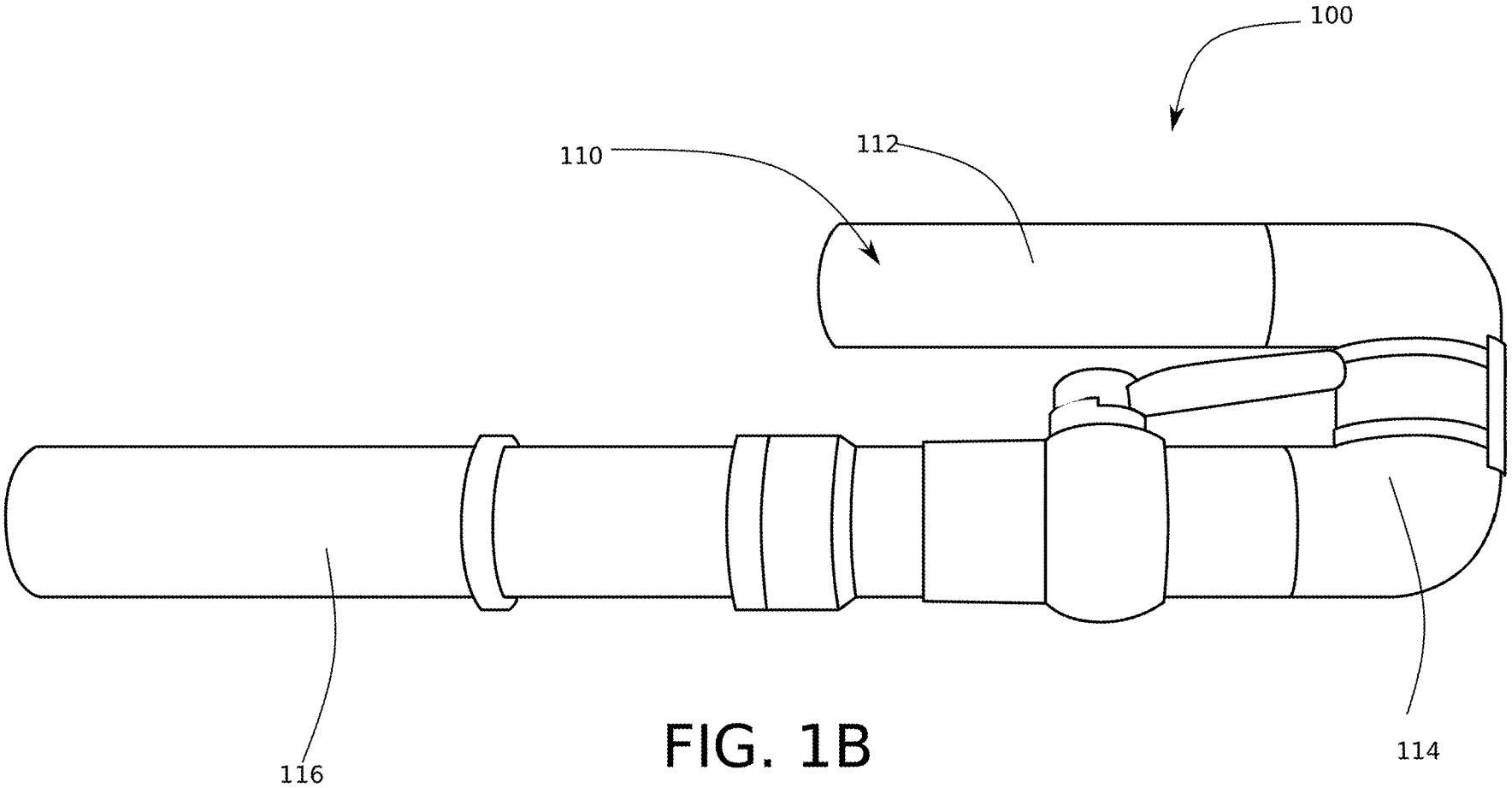
FIG. 1B is a side perspective view of the pneumatic rescue system during an 'in-use' condition, according to an embodiment of the disclosure.

FIGS. 1A-1B show the system 100 according to an embodiment of the present disclosure, particularly FIG. 1A shows the system 100 during an 'in-use' condition. As illustrated, the system 100 may include a housing 110; a tank-section 112; a connector-section 114; a barrel-section 116; and a flotation-device 120. The flotation-device 120 may be configured to provide buoyancy to an individual stranded in a body of water.

According to one embodiment, the system 100 may be arranged as a kit. The kit may include a set of user instructions and an air-tank. The instructions may detail functional relationships in relation to the structure of the system 100 (such that the system 100 can be used, maintained, or the like, in a preferred manner).

Figure 2:
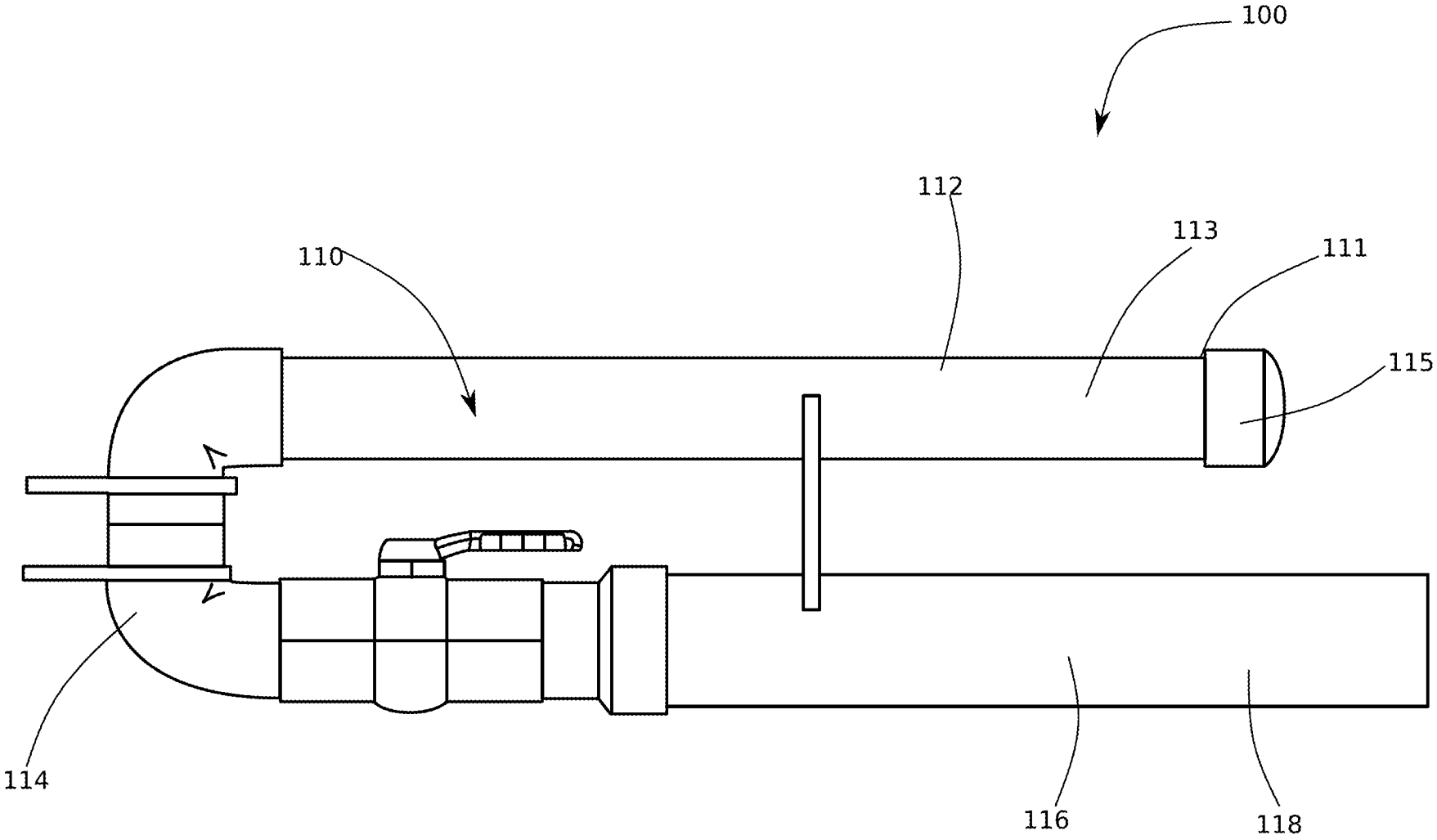
FIG. 2 is a side perspective view of the pneumatic rescue system of FIG. 1A, according to an embodiment of the present disclosure.

FIG. 2 shows a side perspective view of the pneumatic rescue system 100 of FIG. 1, according to an embodiment of the present disclosure. As shown, the housing 110 may include the tank-section 112. The tank-section 112 may include a first-pipe 113 having a pipe-cap 115 attached to a distal-end 111 thereof. The first-pipe 113 may further include an air-capacity configured to receive compressed-air from an air-tank. A connector-section 114 may be included and connected to the tank-section 112; and a barrel-section 116 may be connected to the connector-section 114. The barrel-section 116 may include a second-pipe 118 having a projectile-capacity. As shown, the housing 110 may include a substantially side-ways "U"-shape configuration, whereby the tank-section 112 is a top straight section, the barrel-section 116 is a bottom straight section, and the connector-section 114 is a curved section connecting the two.

The housing 110 may include at least a second plastic material. In some embodiments, the plastic material may be Polyvinyl Chloride (PVC). Particularly 'PVC Schedule 40'. In another embodiment, the plastic material may be High-Density Polyethylene. It is contemplated that there are embodiments where both examples of plastic material are present, along with other materials in some embodiments. In other embodiments, the housing 110 may include metal or other suitably equivalent material.

Figure 3:
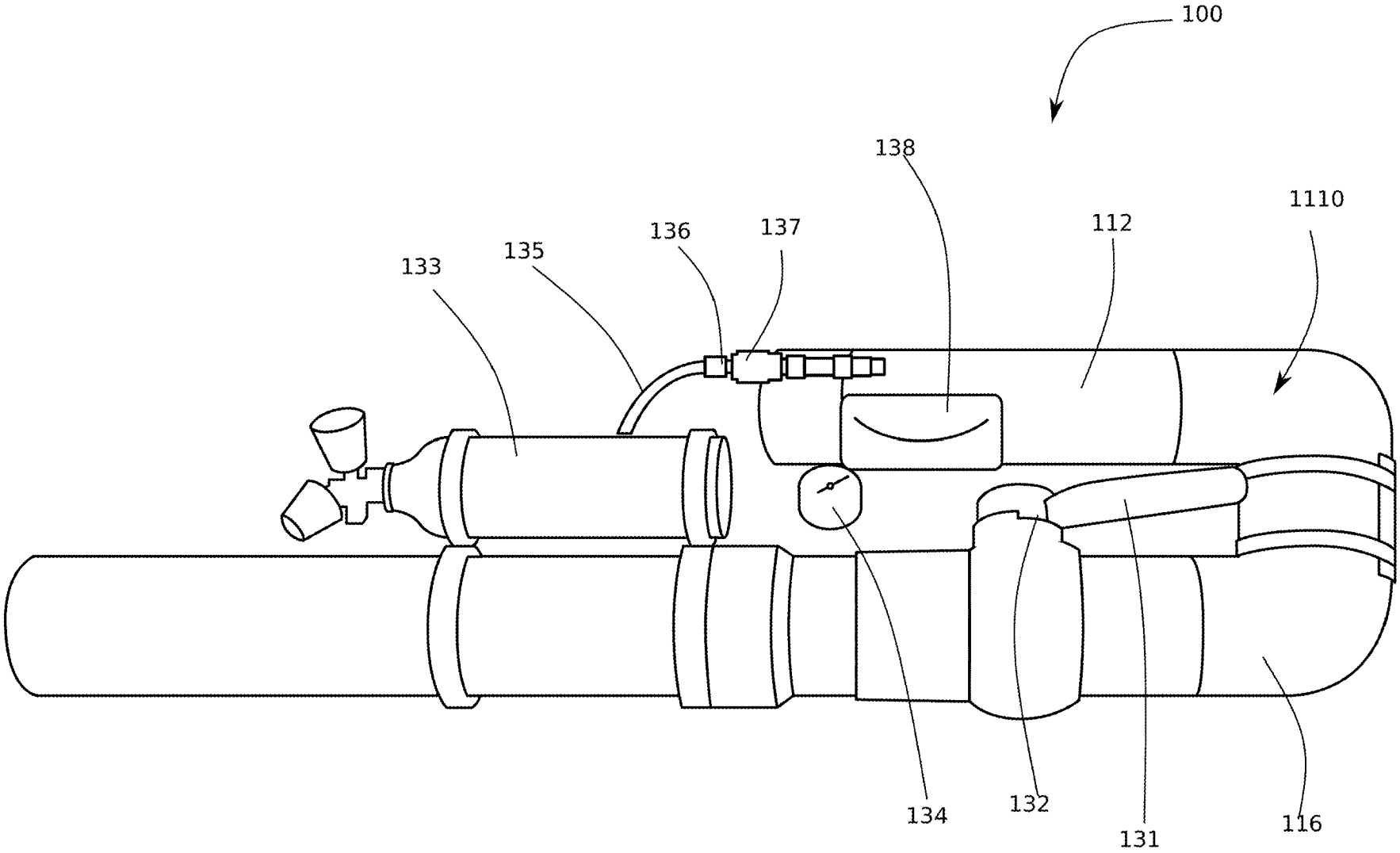
FIG. 3 is a side perspective view of the pneumatic rescue system of FIG. 1A, according to an embodiment of the present disclosure.
Figure 4A:
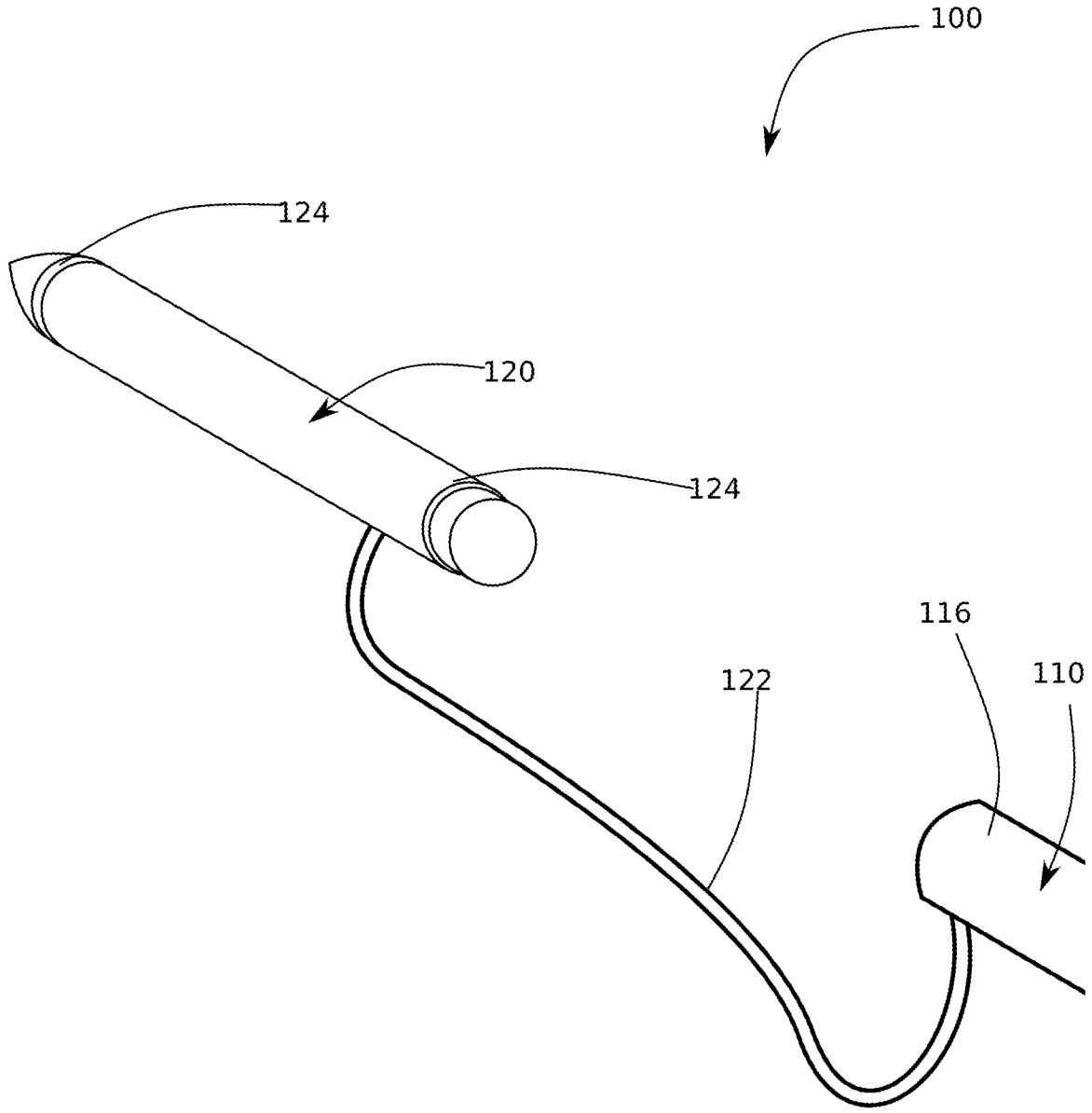
FIG. 4A is a rear side perspective view of the pneumatic rescue system of FIG. 1A, according to an embodiment of the present disclosure.
Figure 4B:
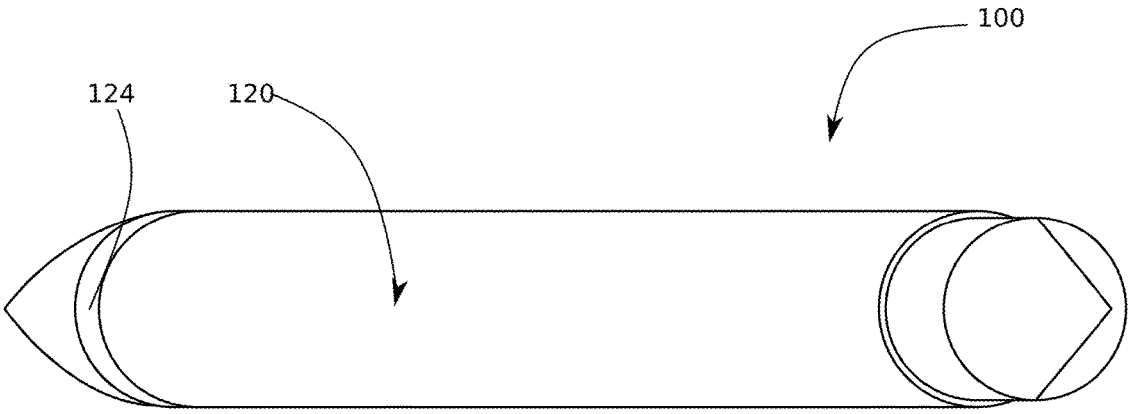
FIG. 4B is a side rear perspective view of the pneumatic rescue system of FIG. 1A, according to an embodiment of the present disclosure.
Figure 4C:
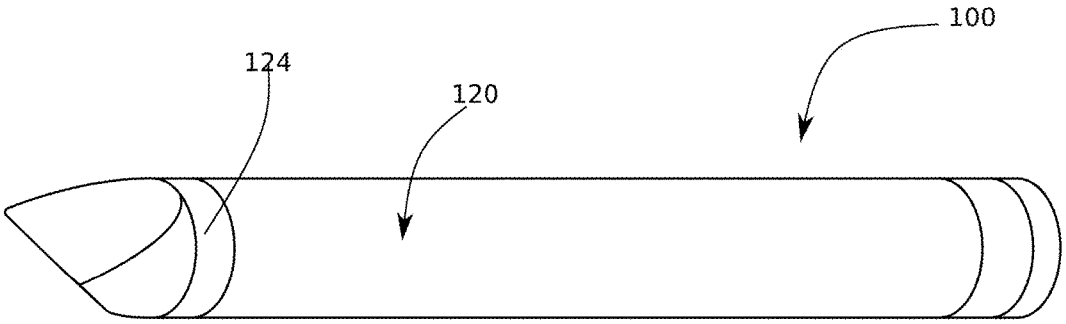
FIG. 4C is a front side perspective view of the pneumatic rescue system of FIG. 1A, according to an embodiment of the present disclosure.
Figure 4D:
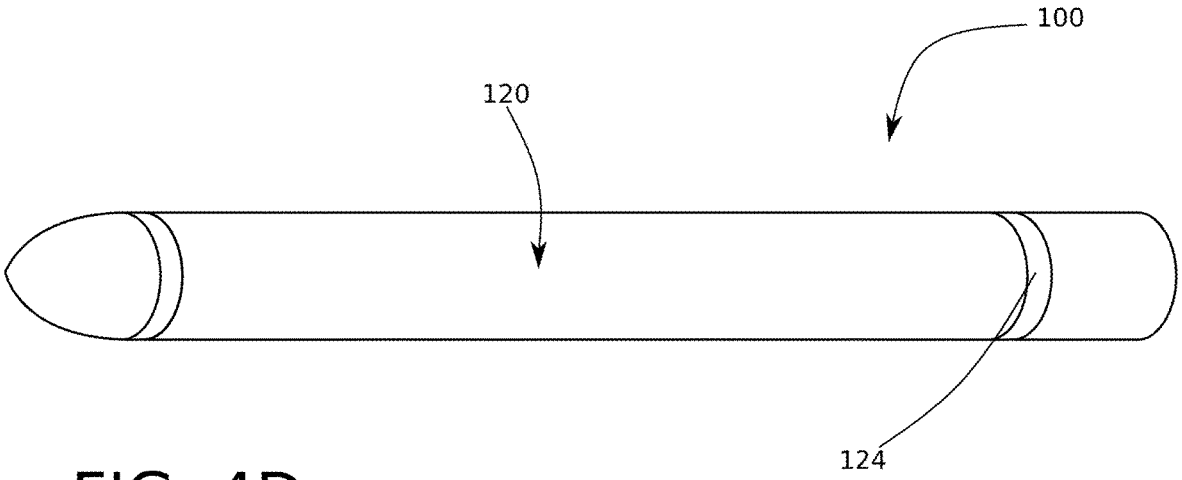
FIG. 4D is a side perspective view of the pneumatic rescue system of FIG. 1A, according to an embodiment of the present disclosure.

FIG. 3 shows a side perspective view of the pneumatic rescue system 100 of FIG. 1, according to an embodiment of the present disclosure. The system 100 may further include elements to permit or aid in use of the system 100. For example, the system 100 may include at least one of a launch valve 132; an air delivery assembly 133; a pressure gauge 134; an inclinometer 138; and a trigger-mechanism 131. Further, the system 100 may include a pipe-adapter; a pipe-extension; a barrel-support, and at least one launch guard.

As shown here, the launch valve 132 may be attached to the housing 110 and in communication with the barrel-section 116. In some embodiments, a safety valve may be included. The safety valve may automatically open ahead of pressure failure. The trigger-mechanism 131 may also be provided in some embodiments and may be in communication with the housing 110. For example, the trigger-mechanism 131 may be attached to the housing 110. The trigger-mechanism 131 may be in communication with the launch valve 132 and be configured to actuate movement of the compressed-air from the tank-section 112 into the barrel-section 116 to exert force on the flotation-device 120 and eject the flotation-device 120 (FIG. 1A) from the projectile-capacity.

The air delivery assembly 133 may be configured for attachment to the housing 110. Preferably, the air delivery assembly 133 may include an air hose 135 configured to receive compressed-air from an air-tank and fill the air-capacity when attached to the housing 110. In one embodiment the air-tank may be a firefighter's air pack, and the air delivery assembly 133 may be configured to couple with the firefighter's air pack.

The air delivery assembly 133 may further include an air chuck 136 and a connector 137 connectable to the air hose 135. In addition to this, the pressure gauge 134 may be attached to the housing 110, and the connector 137 may be in communication with the pressure gauge 134. In one embodiment, the connector 137 may be configured to receive the compressed-air from the air hose 135, direct a substantial portion of the compressed-air into the air-capacity of the tank-section 112, and direct a remaining portion of the compressed-air into the pressure gauge 134. This may allow a user of the system 100 to make sure a correct amount of compressed-air is pumped into the tank-section 112. The pressure gauge 134 may preferably be located on the tank-section 112 for the user to easily view the pressure gauge 134.

As above, the system 100 may further include an inclinometer 138. In one embodiment, the inclinometer 138 may be attached to the tank-section 112. The inclinometer 138 may be particularly useful for allowing the user to measure a tilt of the housing 110, to enable accurate launching of the flotation-device 120.

FIGS. 4A-4D show various perspective views of the pneumatic rescue system 100 of FIG. 1, according to an embodiment of the present disclosure. The flotation-device 120 may be housed within the projectile-capacity. The flotation-device 120 may be configured to be ejected at will from the projectile-capacity upon exertion of a manipulatable force caused via action of the compressed-air on the flotation-device 120. Preferably, the exertion of the force caused via the action of the compressed-air on the flotation-device 120 may be configured to eject the flotation-device 120. In some embodiments, the flotation-device 120 may eject up to 250 feet. However, it should be appreciated that the system 120 is contemplated to eject nearer or farther than 250 feet and is not limited to a distance. It should be appreciated that this length may be less or more in some embodiments.

Further, a rope 122 may be provided to attach to the flotation-device 120 and may allow the user to pull the individual in once the flotation-device 120 has been launched and the flotation-device 120 is under control of the individual. When attaching the rope 122 to the flotation-device 120, the user may create a rescue loop. The rescue loop may be sized for the individual being rescued to put a body part in, such as an arm, or neck. Once the user pulls the rope 122, the rescue loop may tighten (comfortably) over the body part so that the individual is secured to the flotation-device 120. This may be particularly useful if the individual is in and out of consciousness as they will slip from a grip of the rope 122. To attach the rope 122 to the flotation-device 120, and create the rescue loop, the user may do the following: make a FIG. 8 on a bight; lay the bight parallel to the flotation-device 120 approximately ¾ of the way down a body of the flotation-device 120 from a nose cone thereof; just below the nose cone and behind a lock ring of the flotation-device 120, tie a clove hitch down to a core of the flotation-device 120; run the rope parallel to the body and tie a second clove hitch between a pad and the body of the flotation-device 120 down to the core; back out the rope on the FIG. 8 on the bight to make it a FIG. 8; run a free end of the FIG. 8 around the rope; and trace the free end back through the FIG. 8 and tie off.

The flotation-device 120 may preferably include at least one illumination means 124. Preferably, the at least one illumination means 124 may be reflective tape to allow for visibility of the individual in low-light conditions. Particularly, the reflective tape may be yellow reflective tape.

In some embodiments, the at least one illumination means 124 may be lights, such as LED lights, that are waterproof or water resistant. The flotation-device 120 may include at least a first plastic material. The first plastic material may be the PVC material. In some embodiments, the flotation-device 120 may further include at least a foam material. The foam material may be Low-Density Polyethylene-Foam.

FIGS. 4A-4D show various shapes and sizes of the flotation-device 120. In some embodiments, the flotation-device 120 may include a "rocket" shape. Further, the flotation-device 120 may include a center core; a foam core; a chisel point cone; a drag fin; a cone jacket; a foam jacket; a foam seal; at least one counter-weight; a backing plate; at least one retaining ring; and at least one pipe cap. The aerospike fin may include Acrylonitrile Butadiene Styrene (ABS) material. Further, the cone jacket and the foam jacket may include nylon material. It should be appreciated that the list of elements is not exhaustive, and each element is not included in all embodiments. Further, it should be appreciated that any other suitable materials may be used in the system 100. And the system 100 need not always include the listed materials.

Figure 5:
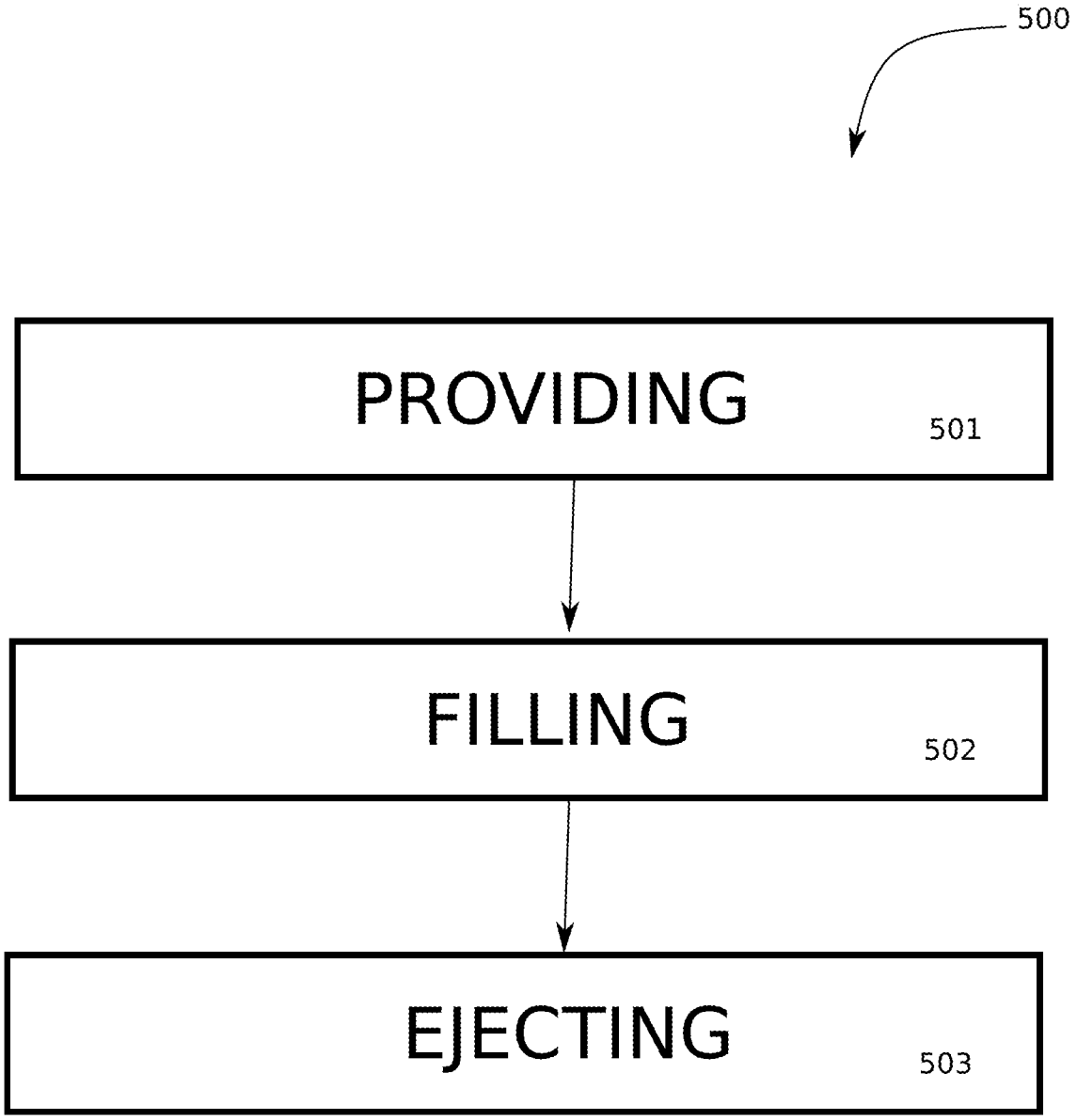
FIG. 5 is a flow diagram illustrating a method of use for the pneumatic rescue system, according to an embodiment of the present disclosure.

FIG. 5 is a flow diagram illustrating a method of using a pneumatic rescue system 500, according to an embodiment of the present disclosure. As illustrated, the method of using a pneumatic rescue system 500 may include the steps of: providing 501 the pneumatic rescue system as above; coupling the air-tank to the tank-section; filling 502 the air-capacity with compressed-air; and ejecting 503 the flotation-device from the projectile-capacity into the body of water.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for pneumatic rescue system 100 (e.g., different step orders within above-mentioned list, elimination or addition of certain steps, including or excluding certain maintenance steps, etc.), are taught herein. Those with ordinary skill in the art will now appreciate that upon reading this specification and by their understanding the art of pneumatic devices as described herein, methods of providing a charge to pneumatic devices and ejecting a projectile via pneumatic charge, will be understood by those knowledgeable in such art.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A pneumatic rescue system comprising:

a housing including:

a tank-section including a first-pipe with an attached pipe cap, the first-pipe further including an air-capacity configured to receive compressed-air from an air-tank, the tank-section further including a straightwalled tube, a first-ninety-degree-elbow, and a second-ninety-degree elbow, such that the tank-section is formed in a J-shape, and the air-capacity occupies interiorly and continuously the J-shape;

a connector-section connected to the tank-section;

a barrel-section connected to the connector-section, the barrel-section including a second-pipe having a projectile-capacity;

a trigger-valve bifurcating the barrel-section, the trigger-valve being inline with the second-pipe of the barrel-section, such that when the trigger-valve is opened, compressed-air within the second-pipe of the tank-section is able to pass into the barrel-section; and a flotation-device housed within the projectile-capacity, the flotation-device configured to provide buoyancy to an individual stranded in a body of water, the flotation-device configured to be ejected at will from the projectile-capacity by compressed-air acting on the flotation-device.

2. The pneumatic rescue system of claim 1, further comprising a launch valve attached to the housing and in communication with the barrel-section.

3. The pneumatic rescue system of claim 1, further comprising an air delivery assembly attached to the housing.

4. The pneumatic rescue system of claim 3, further comprising a pressure gauge attached to the housing.

5. The pneumatic rescue system of claim 3, wherein the air delivery assembly includes an air hose connected to the air-tank and the air-capacity.

6. The pneumatic rescue system of claim 5, wherein the air delivery assembly further includes an air chuck.

7. The pneumatic rescue system of claim 6, wherein the air delivery assembly further includes a connector connected to the air hose.

8. The pneumatic rescue system of claim 7, wherein the connector is in communication with the pressure gauge.

9. The pneumatic rescue system of claim 8, wherein the connector connects the air hose, the air-capacity, and the pressure gauge.

10. The pneumatic rescue system of claim 1, further comprising an inclinometer mounted exteriorly to the housing.

11. The pneumatic rescue system of claim 10, further comprising a rope for attachment to the flotation-device.

12. The pneumatic rescue system of claim 1, wherein the projectile-capacity and the flotation-device are configured to allow reloading the flotation-device into the projectile-capacity for another ejection.

13. The pneumatic rescue system of claim 12, wherein the flotation-device further includes at least a foam material.

14. The pneumatic rescue system of claim 6, wherein the flotation-device includes at least one illumination means.

15. The pneumatic rescue system of claim 6, wherein the housing includes at least a second plastic material.

16. The pneumatic rescue system of claim 6, having an ejection distance of between 200-300 feet.

17. A pneumatic rescue system comprising:

a housing including:

a tank-section including a first-pipe with an attached pipe cap, the first-pipe further including an air-capacity configured to receive compressed-air from an air-tank, the tank-section further including a straightwalled tube, a first-ninety-degree-elbow, and a second-ninety-degree elbow, such that the tank-section is formed in a J-shape, and the air-capacity occupies interiorly and continuously the J-shape;

a connector-section connected to the tank-section;

a barrel-section connected to the connector-section, the barrel-section including a second-pipe having a projectile-capacity;

a trigger-valve bifurcating the barrel-section, the trigger-valve being inline with the second-pipe of the barrel-section, such that when the trigger-valve is opened, compressed-air within the second-pipe of the tank-section is able to pass into the barrel-section; and a flotation-device housed within the projectile-capacity, the flotation-device configured to provide buoyancy to an individual stranded in a body of water, the flotation-device configured to be ejected at will from the projectile-capacity by compressed-air acting on the flotation-device;

a rope for attachment to the flotation-device;

an air delivery assembly attached to the housing;

a pressure gauge attached to the housing; and an inclinometer attached to the tank-section; and wherein the air delivery assembly includes an air hose connected to the air-tank and the air-capacity;

wherein the air delivery assembly further includes an air chuck;

wherein the air delivery assembly further includes a connector connected to the air hose;

wherein the connector is in communication with the pressure gauge;

wherein the connector connects the air hose, the air-capacity, and the pressure gauge;

wherein the flotation-device includes at least a first plastic material;

wherein the flotation-device further includes at least a foam material;

wherein the flotation-device includes at least one illumination means; and wherein the housing includes at least a second plastic material.

18. The pneumatic rescue system of claim 17, further comprising a set of instructions; and wherein the pneumatic rescue system, the air-tank, and the instructions are arranged as a kit.

19. A method of using a pneumatic rescue system, the method comprising the steps of:

providing the pneumatic rescue system including:

a housing including:

a tank-section including a first-pipe with an attached pipe cap, the first-pipe further including an air-capacity configured to receive compressed-air from an air-tank, the tank-section further including a straightwalled tube, a first-ninety-degree-elbow, and a second-ninety-degree elbow, such that the tank-section is formed in a J-shape, and the air-capacity occupies interiorly and continuously the J-shape;

a connector-section connected to the tank-section;

a barrel-section connected to the connector-section, the barrel-section including a second-pipe having a projectile-capacity;

a trigger-valve bifurcating the barrel-section, the trigger-valve being inline with the second-pipe of the barrel-section, such that when the trigger-valve is opened, compressed-air within the second-pipe of the tank-section is able to pass into the barrel-section; and a flotation-device housed within the projectile-capacity, the flotation-device configured to provide buoyancy to an individual stranded in a body of water, the flotation-device configured to be ejected at will from the projectile-capacity by compressed-air acting on the flotation-device;

coupling the air-tank to the tank-section;

filling the air-capacity with compressed-air; and ejecting the flotation-device from the projectile-capacity into the body of water.

* * * * *